US006139692A

United States Patent [19]

Tamura et al.

[11] Patent Number: 6,139,692

[45] Date of Patent: Oct. 31, 2000

[54] METHOD OF CONTROLLING THE OPERATING TEMPERATURE AND PRESSURE OF A COKE OVEN

[75] Inventors: Nozomu Tamura; Tatsuya Ozawa; Tetsuro Uchida; Katsuhiko Sato; Hidetaka Suginobe, all of Chiba, Japan

[73] Assignee: Kawasaki Steel Corporation, Hyogo, Japan

[21] Appl. No.: 09/046,621

[22] Filed: Mar. 24, 1998

[30] Foreign Application Priority Data

Mar. 25, 1997 [JP] Japan ..... 9-071908
Mar. 28, 1997 [JP] Japan ..... 9-077460

[51] Int. Cl.[7] ..... C10B 47/10; C10B 57/02; C10B 57/04

[52] U.S. Cl. ..... 201/44; 201/35; 201/26; 201/1

[58] Field of Search ..... 201/1, 35, 44, 201/26, 38, 45, 41, 18, 10; 202/248, 255

[56] References Cited

U.S. PATENT DOCUMENTS 4,124,450 11/1978 MacDonald ..... 201/15
4,231,845 11/1980 Vander et al. ..... 202/113
5,735,917 4/1998 Inoue et al. ..... 48/201

FOREIGN PATENT DOCUMENTS 31 05 726 3/1982 Germany .
63-170487 7/1988 Japan .
6-041537 2/1994 Japan .
8-283723 10/1996 Japan .
WO96/04352 2/1996 WIPO .

*Primary Examiner*—Marian C. Knode
*Assistant Examiner*—Susan Ohorodnik
*Attorney, Agent, or Firm*—Young & Thompson

[57] ABSTRACT

The pressure in the coking chamber of a coke oven is held at about atmospheric pressure, and the temperatures at the opposite longitudinal ends of the combustion chamber are independently controlled. Fuel gas is supplied to hold the temperature at the opposite longitudinal ends to be at least about 1000° C. separately from a main burner for the combustion chamber, and the pressure in the coking chamber during the first part of coking is kept in a range from 5 $mmH_2O$ below atmospheric to 10 $mmH_2O$ above atmospheric pressure. This allows efficient coke production even with low moisture content coking coal, and coal crumbling near the oven doors is not a problem. The process is typically carried out in a coke oven having a pressure control system for each coking chamber including plural piping devices for supplying a pressure fluid and switching valves for selectively applying the pressure fluid to the nozzle in the rising pipe through any selected one of the piping systems. The fluid pressure applied to the nozzle and the pressure in the coking chamber are preferably changed over time based calculated relationships between carbonization time, coking chamber pressure, and fluid pressure applied to the nozzle.

11 Claims, 10 Drawing Sheets

METHOD OF CONTROLLING THE OPERATING TEMPERATURE AND PRESSURE OF A COKE OVEN

BACKGROUND OF THE INVENTION

1. Field of the Invention

The present invention relates to a method of operating a coke oven and an apparatus for implementing the operating method. More particularly, the present invention relates to an operating method and apparatus for properly adjusting and controlling the temperature and pressure of a coke oven.

2. Description of the Related Art

As shown in FIG. 8, a chamber type coke oven has coking chambers 16 for coking or carbonizing coal charged therein and combustion chambers 15 for burning fuel gas to supply heat necessary for carbonization of coal, which are arranged alternately side by side. A partition wall of firebricks, such as silica bricks, is formed between the coking chamber and the combustion chamber. Heat of combustion generated in the combustion chamber is transferred through the partition wall so that the heat is supplied to the coal in the coking chamber for carbonization. The coking chamber has several coal charging ports 17 formed at the top thereof, and doors 1 provided at opposite longitudinal ends of the coking chamber and including firebricks disposed on their inner surfaces. After the coal is carbonized into coke, both doors are opened and the coke in the coking chamber is pushed out by a pushing device 20 from the device side to the opposite side where a coke guide car 21 is positioned.

During carbonization of coal, volatile components of the coal are converted to coking gas. The coking gas is collected in a dry main 29 via a rising pipe 31 extending above the top of each coking chamber and then delivered to a coking gas storage facility.

Recently, in the field of coke production using chamber type coke ovens, a method of adjusting the moisture content of coal before carbonizing the coal has been employed for the purposes of reducing the amount of heat required for the carbonization and achieving a more uniform distribution density of the charged coal. According to that method, the coke oven is generally operated by adjusting the moisture content of coal to be not higher than 6% while taking measures to prevent coal dust from generating when the coal is charged. However, when using chamber type coke ovens with coal adjusted to have a reduced moisture content, because the coal surface has less moisture adhering thereto, cohesion between the coal surfaces is much lower than in ordinary wet coal having a moisture content of 9–12%.

FIGS. 9A and 9B show a door of a chamber type coke oven wherein gas passageways 3 are formed in the vertical direction to improve ventilation of coking gas for preventing a rise of gas pressure in the vicinity of the door surface. But when carbonization of coal occurs more slowly near the door, coal 6 having low cohesion crumbles into the gas passageways 3 to block ventilation of coking gas, thus causing the gas to leak through the door due to a rise of gas pressure in the vicinity of the door surface, as shown in FIG. 10.

The technique disclosed in Japanese Unexamined Patent Publication No. 63-170487 is known as a method of improving unevenness of coking in a direction in which coke is pushed out of the coke oven (referred to as a longitudinal direction hereinafter). The disclosed method employs an end flue burner to achieve more uniform coking in the longitudinal direction of the coking chamber.

However, even with the use of the end flue burner which can selectively raise the temperature at each longitudinal end of the combustion chamber (i.e., the end flue), a delay of carbonization in the initial coking stage cannot be prevented because the door surface has a lower temperature than the wall surface of the coking chamber. Furthermore, if the longitudinal direction of the coking chamber is heated over 1300° C. to have a temperature as high as other portions of the coking chamber for preventing a delay of carbonization in the initial coking stage, not only the amount of heat required for the carbonization would be lost, but also silicon bricks as refractories in the combustion chamber would be melted away with a resulting considerable reduction in life of the combustion chamber.

A method for limiting the pressure in a space above a coal-charging section of the coking chamber during the coking period is disclosed in Japanese Unexamined Patent Publication No. 3-177493. According to the disclosed method, coking gas is effectively vented to the space above the coal-charging section of the coking chamber for improving the carbonization efficiency. That method, however, does not contribute to an improvement of carbonization at the longitudinal end of the coking chamber.

Thus, in the above techniques, when coal adjusted to have a moisture content of not higher than 6% is carbonized by using the chamber type coke oven having gas passageways 3 defined between oven bricks 4 and door bricks 2 and extending along the end of the coking chamber on the open air side, it has been impossible to effectively prevent the coal from crumbling into the gas passageways due to slower carbonization, thereby to block ventilation of coking gas, whereupon the gas pressure in the vicinity of the door surface rises so high as to cause gas leakage through the door.

Furthermore, a rise of the pressure in the coking chamber due to gas generated upon coking and carbonization of coal increases a possibility that the generated coking gas may leak to the outside of a coke oven through gaps in a coal charging port of the coking chamber or an oven door. Also, if there are joint cracks in a partition wall made of firebricks due to time-lapse changes in the coke oven, powder dust or the like flows from the coking chamber side to the combustion chamber side, resulting in black smoke being mixed in exhaust gas from the combustion chamber. To cope with that problem, it is conventional to eject a pressure fluid (typically water or water vapor) into a rising pipe, thereby decreasing the pressure in the coking chamber by an ejector effect. However, the pressure of generated coking gas is not uniform from the initial stage to the final stage, but varies such that it is high in the initial stage just after charging coal and then decreases gradually. The pressure of the pressure fluid ejected into the rising pipe therefore need not be kept constant at all times.

To keep the pressure in a coking chamber lower than atmospheric pressure, with the above point in mind, Japanese Unexamined Patent Publication No. 6-41537 discloses a method of measuring the pressure in the coking chamber, producing a control signal depending on a pressure difference between the measured pressure and the desired pressure set to be lower than the atmospheric pressure, and adjusting the gas suction pressure in the rising pipe by opening/closing a control damper provided in the rising pipe, or blowing a pressure fluid into the rising pipe, or a combination of both those means in accordance with the control signal. However, a large amount of coking gas including a tar component is generated in the carbonizing process of coke, and therefore when means for measuring the pressure in the oven is provided for each chamber as disclosed in the above publication, tar is cooled and attached to a measuring device or a lead-in portion thereof to such an extent in some cases that the measuring device fails to operate for adjustment of the pressure in the oven because of clogging caused by the attached tar. A lot of labor and time are therefore required for maintenance. In addition, if the pressure fluid blown into the rising pipe is controlled by using only high-pressure water for the overall period from the coal charging to the end stage of carbonization, considerable wear of the control valve would result. Also, if the control damper provided in the rising pipe is opened only slightly, clogging would often occur due to tar cooled by the high-pressure water. Thus, the technique disclosed in the above-cited Japanese Unexamined Patent Publication No. 6-41537 has many problems to be overcome from the practical point of view.

SUMMARY OF THE INVENTION

Accordingly, an object of the present invention is to overcome the above-stated problems in the related art by providing a technique which can effectively prevent the crumbling of coal into the gas passageways and the attendant problems.

A further object of the present invention is to provide a technique for controlling the pressure in each coking chamber of a coke oven by controlling the suction of coking gas while avoiding problems with tar.

To achieve the above object, the present invention provides a method of operating a coke oven made up of coking chambers and combustion chambers, comprising charging coal into the coking chambers, adjusting and holding the pressure in each of the coking chambers during the initial stage of coking at a value at or near atmospheric pressure, and holding the temperature at both longitudinal ends of each of the combustion chambers within a predetermined range independently of one another.

Also, the present invention provides a method of operating a chamber type coke oven including gas passageways for coking coal adjusted to have a relatively low moisture content, and comprising the steps of adjusting and holding the pressure in each of the coking chambers during the initial stage of coking at a value at or near the atmospheric pressure, and supplying fuel gas and combustion gas to both longitudinal ends of each combustion chamber separately from a main burner for the combustion chamber, thereby controlling the temperature at both the longitudinal ends of the coking chamber, whereby charged coal can be prevented from crumbling into the gas passageways and in turn gas leakage through the oven doors can be prevented. In this method, it is preferable that the pressure in the coking chamber during the first 20% of the total coking time is kept in a range from a value 5 $mmH_2O$ lower than atmospheric pressure to a value 10 $mmH_2O$ higher than atmospheric pressure, and the temperature at both longitudinal ends of the combustion chamber is set to at least about 1000° C.

To adjust and control the pressure in the coking chamber, it is preferable first to determine the relationship between the carbonization time and the pressure in the coking chamber, and the relationship between the fluid pressure applied to a nozzle in a rising pipe and the pressure in the coking chamber for each of the coking chambers constituting the coke oven, and then to change the fluid pressure applied to the nozzle and the pressure in the coking chamber over time based on those relationships, depending on the predetermined carbonization time.

The above techniques are smoothly implemented by providing a pressure adjusting apparatus for a coking chamber in a coke oven operated according to the present invention.

To that end, the present invention further provides a pressure adjusting apparatus including a plurality of piping systems for supplying a pressure fluid, and switching valves enabling the pressure fluid to be selectively supplied to the nozzle in the rising pipe through any of the piping systems.

In this connection, it is preferable that the pressure adjusting apparatus includes a piping system for supplying a pressure fluid at a fluid pressure of at least 30 $kg/cm^2$, a piping system for supplying a pressure fluid at a fluid pressure which is adjustable in the range of 5–20 $kg/cm^2$, and a piping system for supplying the pressure fluid at a fluid pressure of not higher than 5 $kg/cm^2$, the switching valves enabling the pressure fluids to be selectively supplied to the nozzle in the rising pipe provided in the coke oven through the piping systems.

Moreover, the present invention provides a coke oven including the pressure adjusting apparatus stated above.

Still further, the present invention provides a coke oven including heater for heating both longitudinal ends of each combustion chamber, in addition to the pressure adjusting apparatus stated above.

Further details of the present invention will be apparent from the following description taken with reference to the drawings.

DESCRIPTION OF THE PREFERRED EMBODIMENTS

Figure 1:
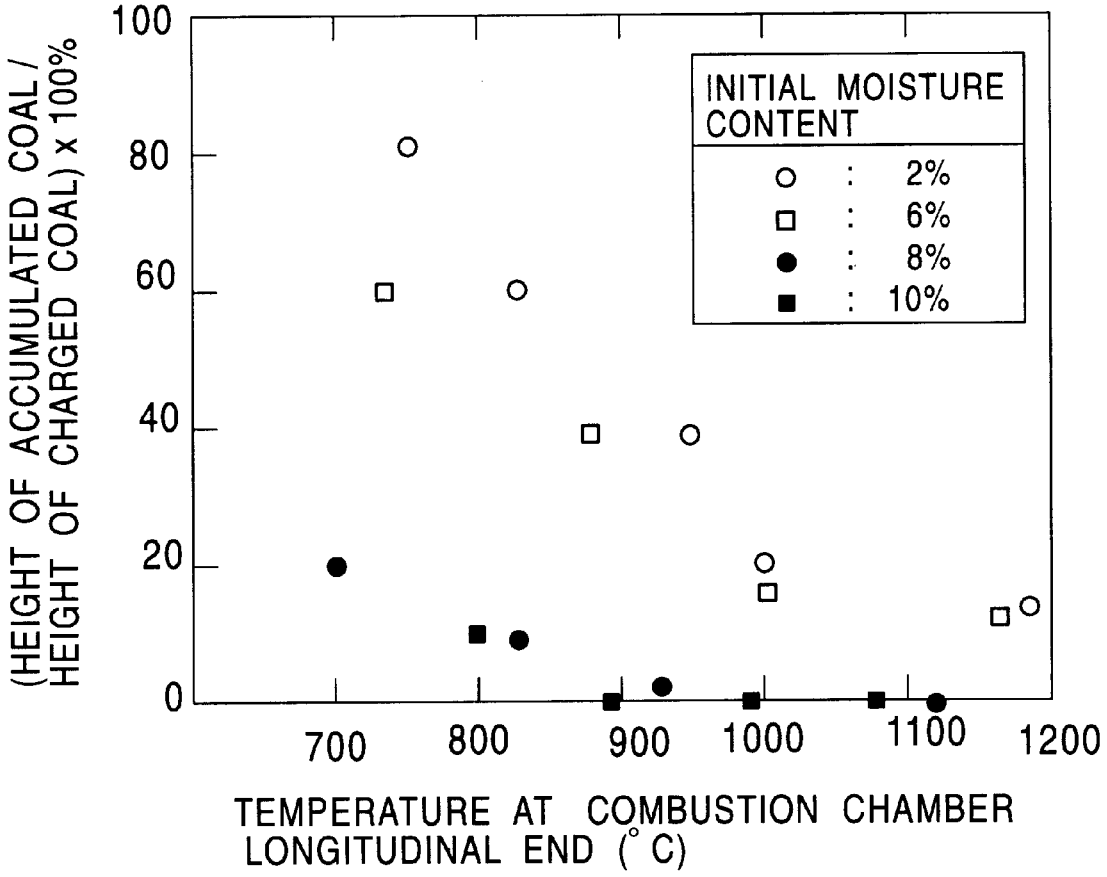
FIG. 1 is a characteristic graph showing the relationship between the temperature at a combustion chamber longitudinal end and a proportion of the height of coal accumulated in the gas passageways.
Figure 9A:
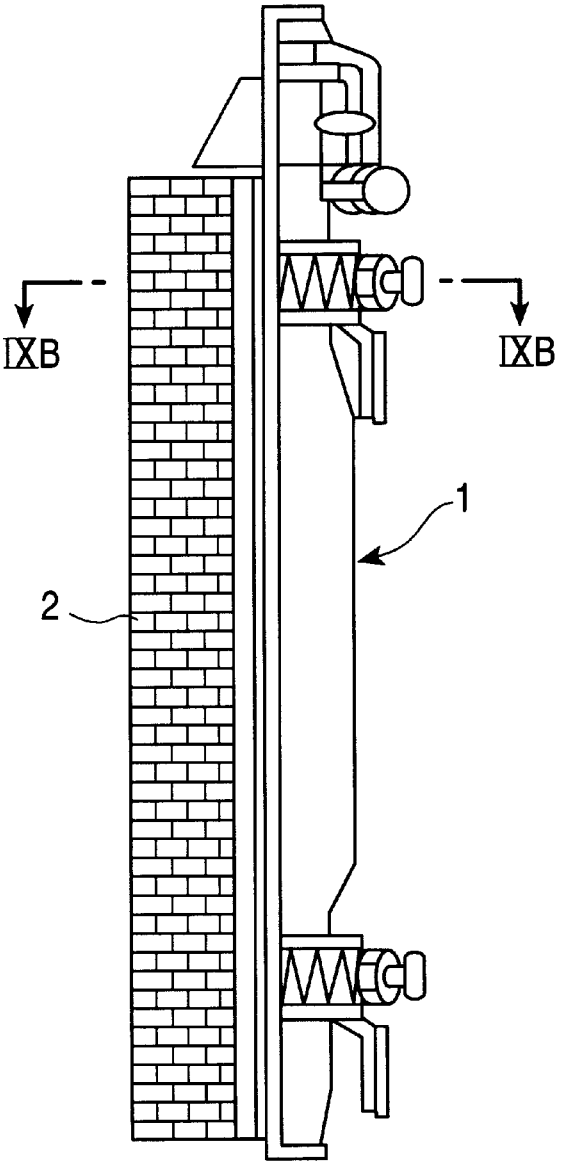
FIG. 9A PRIOR ART
FIG. 9A is a side view of a door of FIG. 8.
Figure 9B:
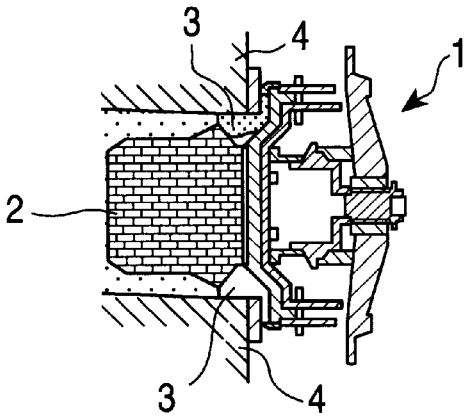
FIG. 9B PRIOR ART
FIG. 9B is a cross-sectional view taken along the line IXB—IXB in FIG. 9A.
Figure 10:
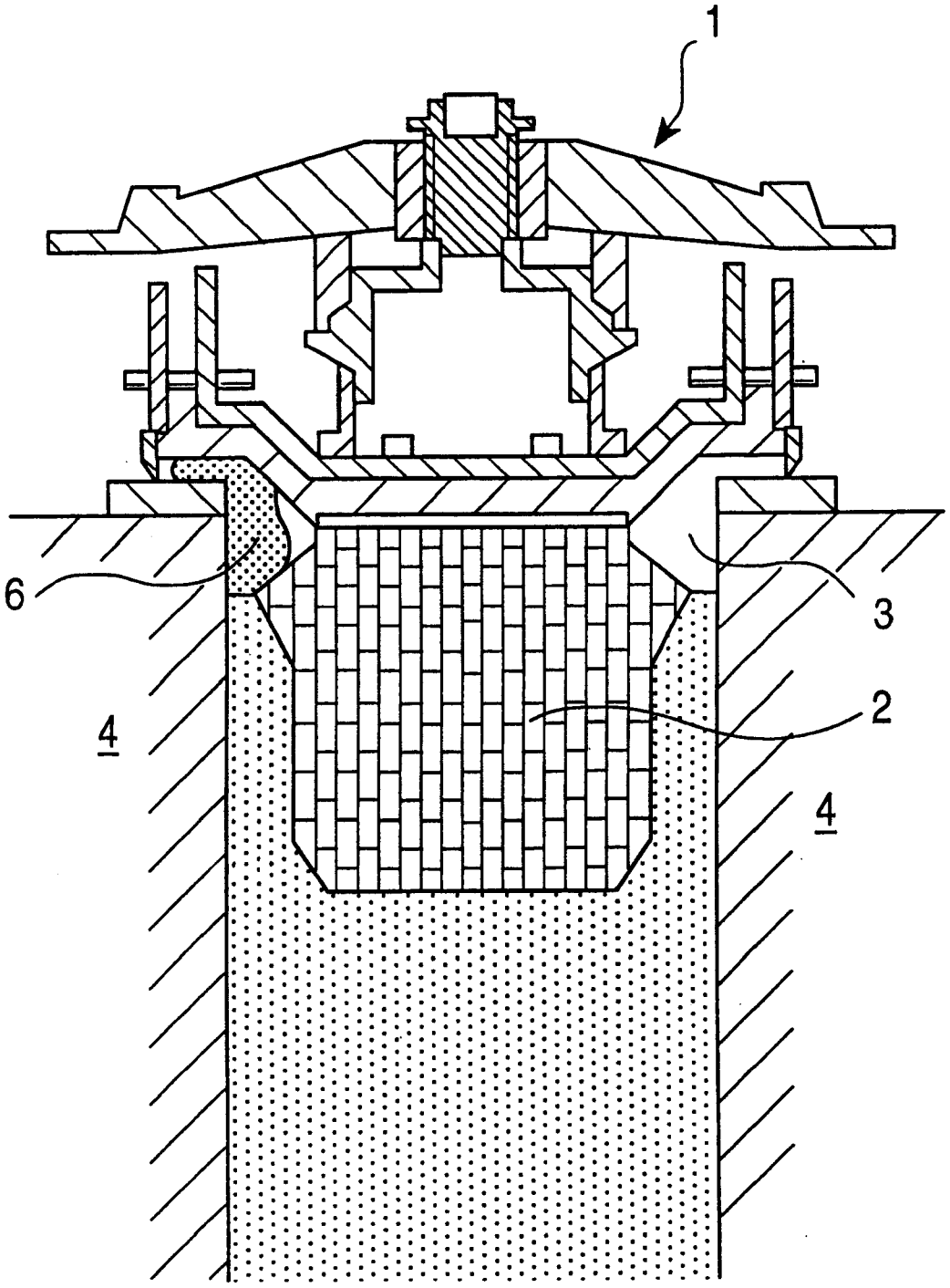
FIG. 10 PRIOR ART
FIG. 10 is an enlarged view of FIG. 9B, for explaining a state wherein coal has crumbled into gas passageways.

FIG. 1 shows the relationship between the temperature at each of the two longitudinal ends of a combustion chamber near a door of a chamber type coke oven, and a value calculated by dividing the height of coal accumulated in the gas passageways by the height of coal charged in a coking chamber, for different values of initial moisture content of coal (i.e., values of moisture content of coal just before charging). The door used here is a door having gas passageways which are defined between the oven bricks 4 and the door bricks 2 and extend vertically of the coking chamber, as shown in FIGS. 9 and 10. The temperature at the combustion chamber longitudinal end was measured when coke is pushed out of the oven, and the height of accumulated coal means the height of coal that stays in the gas passageways 3 when the door is opened.

When the initial moisture content of coal was not lower than 8%, the gas passageways were not clogged even with the temperature at the combustion chamber longitudinal end being as low as about 900° C. However, when the initial moisture content of coal was 6% or less, the gas passageways were clogged at the lower end of the door even with the temperature at the combustion chamber longitudinal end being raised to over 1000° C. It was also observed that the height of accumulated coal increased after the door had been opened and closed repeatedly. Thus, the inventors found that, for coal having an initial moisture content of not higher than 6%, it was impossible to prevent the clogging of the gas passageways merely by raising the temperature at the combustion chamber longitudinal end.

Figure 2:
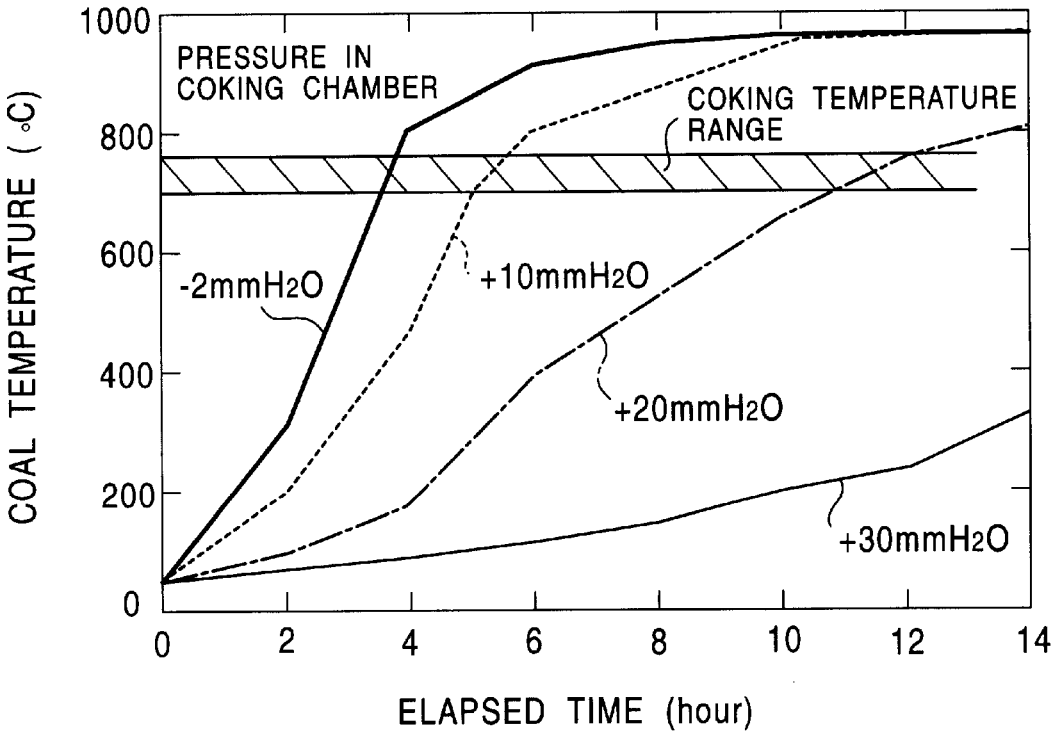
FIG. 2 is a characteristic graph showing changes in temperature rise of coal near the door surface at different pressures in a coking chamber.

For a coking chamber provided with a door having gas passageways defined between the oven bricks 4 and the door bricks 2 and extending vertically along the end of the coking chamber on the open air side, as shown in FIG. 9, the temperature at the combustion chamber longitudinal end was set to 1000° C. to make the gas passageways less clogged, whereas the pressure of water supplied to a water spray provided midway along the rising pipe and the opening degree of a gas recovery valve were varied for controlling the pressure in the coking chamber, i.e., the pressure in a space above a coal-charging section of the coking chamber, to a predetermined value. A through-hole was formed to penetrate the door brick and a JIS K-type sheath thermometer was installed in the through-hole to measure the coal temperature in a coal layer at a position spaced 10 mm from the door brick surface. The measurement results are shown in FIG. 2, as the rise in coal temperature near the door surface at different pressures in the coking chamber relative to atmospheric pressure. Additionally, the coal coking time in the entirety of the coking chamber was 25 hours in this experiment.

As seen from FIG. 2, the inventors found that the rising curves of the coal temperature were considerably different from each other depending on the pressure in the coking chamber.

Figure 3:
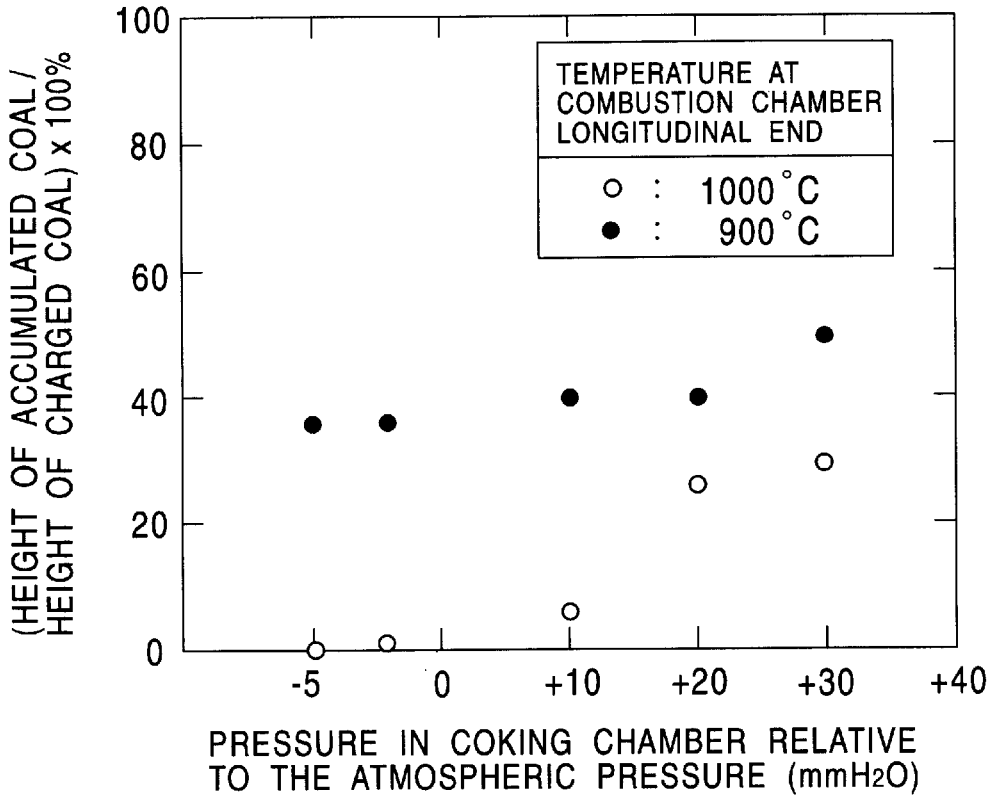
FIG. 3 is a characteristic graph showing the relationship between the difference in pressure in the coking chamber from atmospheric, and the proportion of the height of coal accumulated in the gas passageways.

The relationship between the pressure in the coking chamber and a proportion of the height of coal accumulated in the gas passageways, resulting from this experiment, is plotted by white circles in FIG. 3.

In the case where coal having the initial moisture content of 2%–6% was charged, the temperature at the combustion chamber longitudinal end was set to 1000° C., and the pressure in the coking chamber was held at a normal value without control, the proportion of the height of coal accumulated in the gas passageways was about 20% as seen from FIG. 1. On the other hand, as seen from FIG. 3, the proportion of the height of coal accumulated in the gas passageways was in the range of 25–30% when the pressure in the coking chamber was +20 $mmH_2O$ and +30 $mmH_2O$ above the atmospheric pressure. Thus, there was not a significant difference between both the cases. However, the proportion of the height of accumulated coal was 3% at the pressure in the coking chamber of +10 $mmH_2O$ and the accumulated coal was hardly found at −5 $mmH_2O$. These two cases demonstrated that the gas passageways were not substantially clogged.

For comparison, a similar experiment was conducted except for the temperature at the combustion chamber longitudinal end being set to 900° C. As seen from results (indicated by black circles in FIG. 3), the proportion of the height of accumulated coal was in the range of 39–50% at the pressure in the coking chamber of +20 $mmH_2O$ and +30 $mmH_2O$ above the atmospheric pressure, and was in the range of 35–40% even at the pressure in the coking chamber of +10 $mmH_2O$ and −5 $mmH_2O$; hence a significant improvement was not obtained. This means that, in a coke oven having a door provided with gas passageways, the crumbling of coal into the gas passageways cannot be prevented simply by keeping the pressure low in the coking chamber. Instead, the present invention recognizes that, to cause a gas flow to enter the coal layer near the door surface so as efficiently to promote heat transfer into that coal layer, it is necessary to maintain low pressure in combination with maintenance of high temperature at the combustion chamber longitudinal end. This novel finding is by no means apparent from the related art discussed above.

The coking temperature for coking coal is generally in the range of 700–750° C. As seen from FIG. 2, it was found that the time required for reaching the coking temperature was about 4 hours and 5 hours at the pressures in the coking chamber of −2 $mmH_2O$ and +10 $mmH_2O$, respectively, but was in excess of 10 hours at the pressure in the coking chamber of at least +20 $mmH_2O$.

In other words, it was found that the proportion of the height of coal accumulated in the gas passageways could be reduced by heating the chamber longitudinal end to reach the coking temperature in about 4–5 hours. This is believed to be a result of reducing the extent of crumbling of coal into the gas passageways by promoting the earlier coking of the coal near the chamber longitudinal end during the initial stage of carbonization. In this connection, the total coking time was 25 hours. Thus, since the total coking time in the chamber type coke oven is generally in the range of about 20–25 hours, it has been found that the problem of crumbling of coal into the gas passageways can be prevented by completing coking of the coal near the chamber longitudinal end during the first 20% of the total coking time. Total coking time (or gross coking time) is defined as the time from the start of charging coal to the end of pushing out coke, and is thus the sum of net coking time and soaking time.

Thus, by raising the temperature at the combustion chamber longitudinal end to 1000° C. during the first 20% of the total coking time, and by controlling the pressure in the coking chamber to be not more than about 10 $mmH_2O$ above the atmospheric pressure, it is possible to prevent coal from crumbling into the gas passageways formed along the longitudinal end of the coking chamber and to prevent gas leakage through the door that would otherwise be caused by accumulation of coal in the gas passageways. It should be noted in this regard that a higher temperature at the combustion chamber longitudinal end is more effective in raising the coal temperature in the coking chamber. It is therefore preferable that the temperature at the combustion chamber longitudinal end be at least about 1000° C. On the other hand, the pressure in the coking chamber should not be higher than about 10 $mmH_2O$ above the atmospheric pressure. However, it was observed that coking chamber pressures lower than about 5 $mmH_2O$ below the atmospheric pressure, although causing no problems in the amount of coke accumulated in the gas passageways, appeared to cause coal and tar component that had been deposited and filled in joints between bricks in portions of the coking chamber defining the gas passages, to be consumed by burning. Consumption of the deposited coal and tar component by burning must be prevented because it may give rise to joint cracks and in turn cause coking gas to leak to the combustion chamber. In the present invention, therefore, it is preferred that a lower limit of the pressure in the coking chamber be set to about 5 $mmH_2O$ below the atmospheric pressure.

EXAMPLE 1

Using a chamber type coke oven having an average chamber width of 450 mm, a chamber length of 15 m and a coal charging capacity of 35 tons, coal which was previously adjusted to have a moisture content of 5.5% was carbonized at a combustion chamber temperature of 1100° C. for a total coking time of 25 hours. The coke oven was operated by cyclically repeating the steps of coal charging, coking and pushing-out. The oven door was as shown in FIG. 9 and was used continuously throughout the operation.

Figure 7:
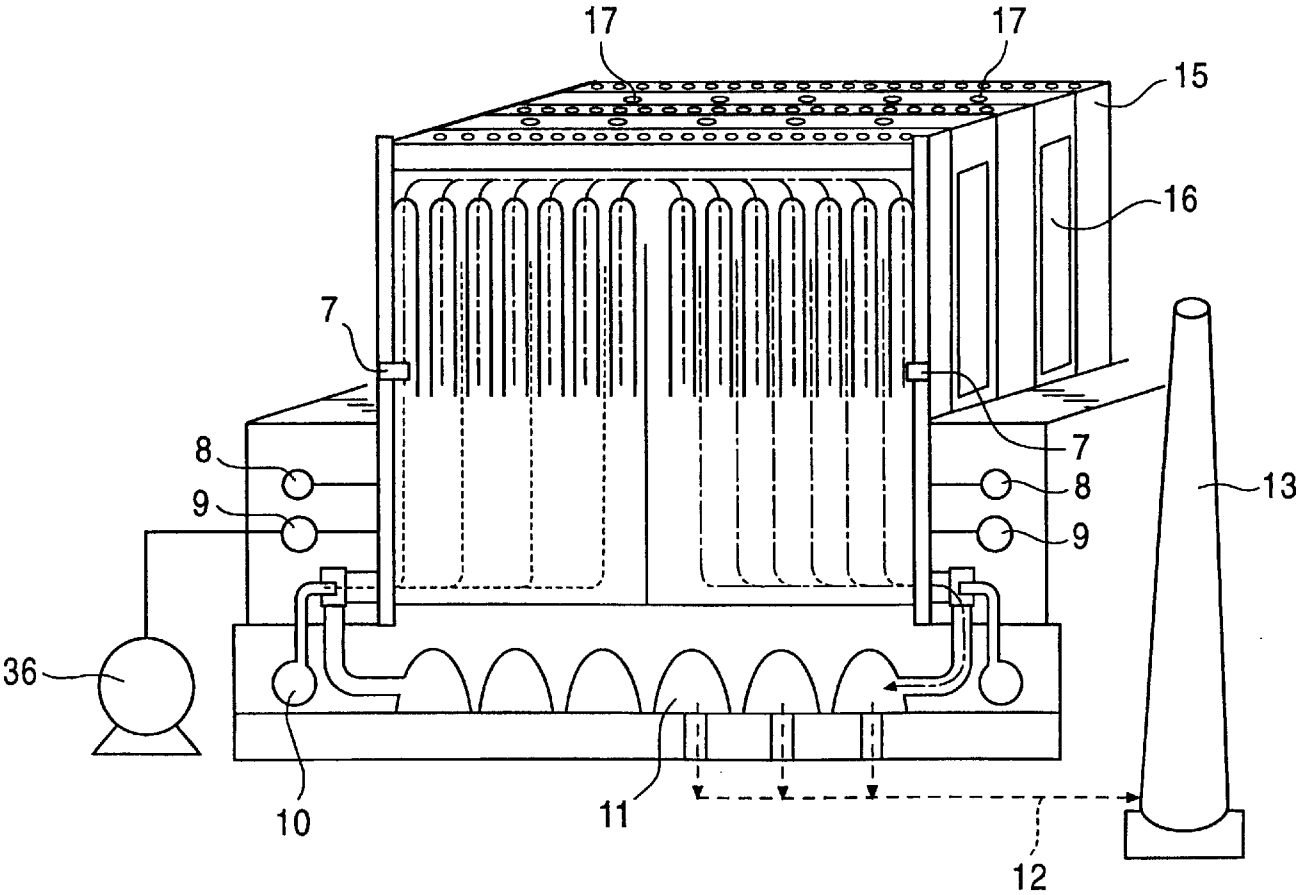
FIG. 7 is a schematic perspective view showing an end flue burner for a combustion chamber of the coke oven and a gas flow therein.
Figure 8:
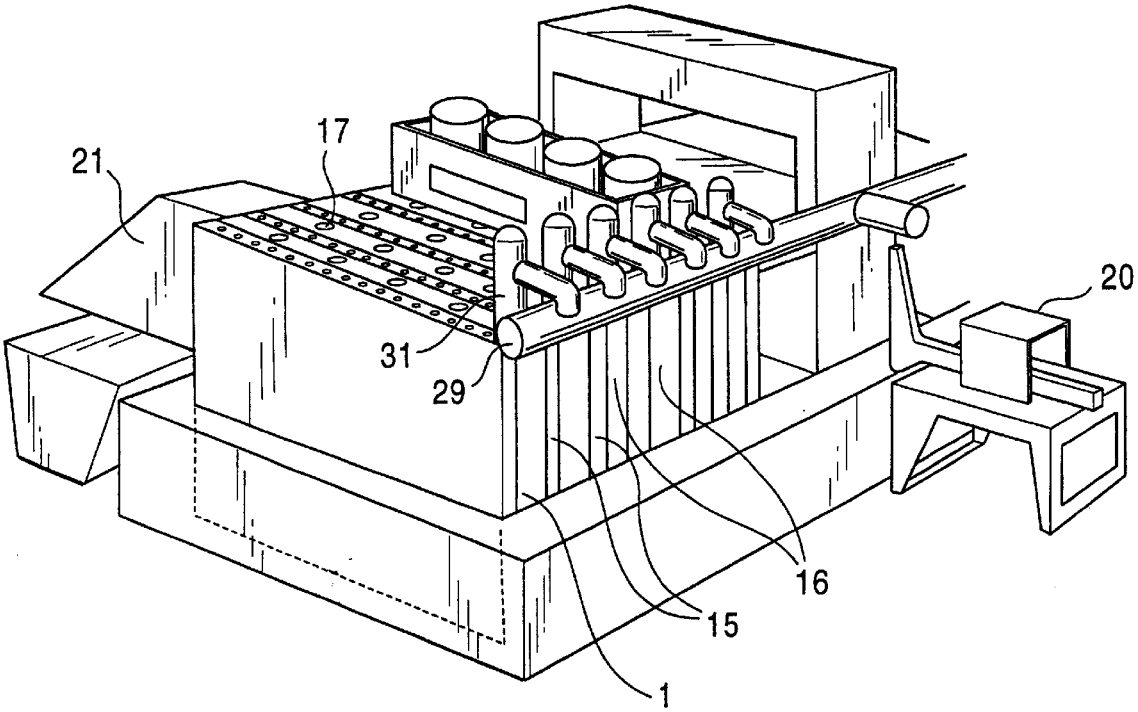
FIG. 8 PRIOR ART
FIG. 8 is a conceptual view of a conventional chamber type coke oven.

As shown in FIG. 7, coke oven gas (C gas) was supplied to an end flue burner 7 through a C gas pipe 8 independently of a mixture of the C gas and blast furnace gas (M gas) in pipe 10, and air was supplied by a fan 36 to the end flue burner 7 through an air pipe 9, for burning the coke oven gas. The temperature in the combustion chamber was kept at a predetermined value by adjusting the relative supply rates of the coke oven gas and the air. The relative supply rates of the coke oven gas and the air can be adjusted by using valves (not shown) provided at each pipe 8 and 9. Further fine adjustment of the relative supply rates is possible by providing a branch pipe to each end flue burner with a valve (not shown).

M gas was supplied through the M gas pipe 10 and burnt while passing flues in the combustion chamber. The waste gas from the end flues (C gas) and other flues (M gas) was then exhausted through a sub waste gas flue 11, a main waste gas flue 12, and a chimney 13.

The operation of the coke oven was continued for 10 days by repeating the process wherein the temperature at the combustion chamber longitudinal end was adjusted to be in the range of 1000–1020° C. by using the end flue burner 7 shown in FIG. 7, and the spray pressure applied to a nozzle was set to be in the range of 4–7 kg/cm to hold the pressure in the coking chamber in the range of about +5 to +10 $mmH_2O$, relative to atmospheric, for 5 hours after charging the coal.

Comparative Example 1—1

Coal adjusted to have the same characteristics as in Example 1 was carbonized using the same equipment and process conditions as in Example 1, except as follows:

The operation of the coke oven was continued for 10 days by repeating a process wherein the temperature at the combustion chamber longitudinal end was adjusted to fall in the range of 1100–1150° C. by using the end flue burner 7 and the spray pressure was set to fall in the range of 2–3 $kg/cm^2$ to hold the pressure in the coking chamber in the range of −2 to +30 $mmH_2O$, relative to atmospheric, after charging the coal. The time during which the pressure in the coking chamber exceeded +10 $mmH_2O$ in respective cycles was 5 hours of the total coking time.

Comparative Example 1-2

Coal adjusted to have the same characteristics as in Example 1 was carbonized using the same equipment and process conditions as in Example 1, except as follows:

The operation of the coke oven was continued for 10 days by repeating a process wherein the temperature at the combustion chamber longitudinal end was adjusted to fall in the range of 900–950° C. by using the end flue burner 7 and the spray pressure was set to fall in the range of 4–7 $kg/cm^2$ to hold the pressure in the coking chamber in the range of +5 to +10 $mmH_2O$, relative to atmospheric, after charging the coal.

The proportion of the height of coal accumulated in the gas passageways near the door was measured each time the coal was pushed out of the oven, and when the measured value was over 50%, the coal accumulated in the gas passageways was removed. Further, each experiment was conducted by mounting a new door to the oven and checking the number of days until gas leakage, i.e., the number of days from the starting day in which there was no gas leakage to the day in which gas leakage was found to begin, and a gas leakage rate for the 10 days. The gas leakage rate was obtained by observing gas leakage after 30 minutes from each charging of the coal, and determining whether gas leakage occurred or not.

The results are shown in Table 1.

TABLE 1

| | Ex. 1 | Comp. Ex. 1-1 | Comp. Ex. 1-2 |
|---|---|---|---|
| Max. value of proportion of height of accumulated coal (%) | 3 | 50 | 50 |
| Number of operations for removing accumulated coal | 0 | 2 | 9 |
| Number of days until gas leakage (days) | 0 | 3 | 2 |
| Gas leakage rate (%) | 0 | 60 | 90 |

As is evident from Example 1, in the operation according to the present invention, almost no coal was accumulated in the gas passageways, it was not necessary to remove accumulated coal, and gas leakage through the door had not occurred after 10 days.

On the other hand, in Comparative Example 1—1, although the amount of accumulated coal was somewhat reduced, on the sixth day the proportion of the height of accumulated coal exceeded 50% at which time it was necessary to remove the accumulated coal. Since removal of the accumulated coal was performed manually, the accumulated coal was not completely removed and therefore the coal removal operation was required again on the fourth day (last day) after resuming the operation of the oven. Gas leakage was observed on the third to sixth days and then on the ninth to tenth days.

In Comparative Example 1-2, the amount of accumulated coal increased so quickly that on the second day the proportion of the height of accumulated coal exceeded 50% at which time it was necessary to remove the accumulated coal. After the second day, the coal removal operation was required every day. Gas leakage was not found on the first day, but occurred each day thereafter.

An apparatus and a process for controlling the pressure in the coking chamber will be explained below.

Figure 6:
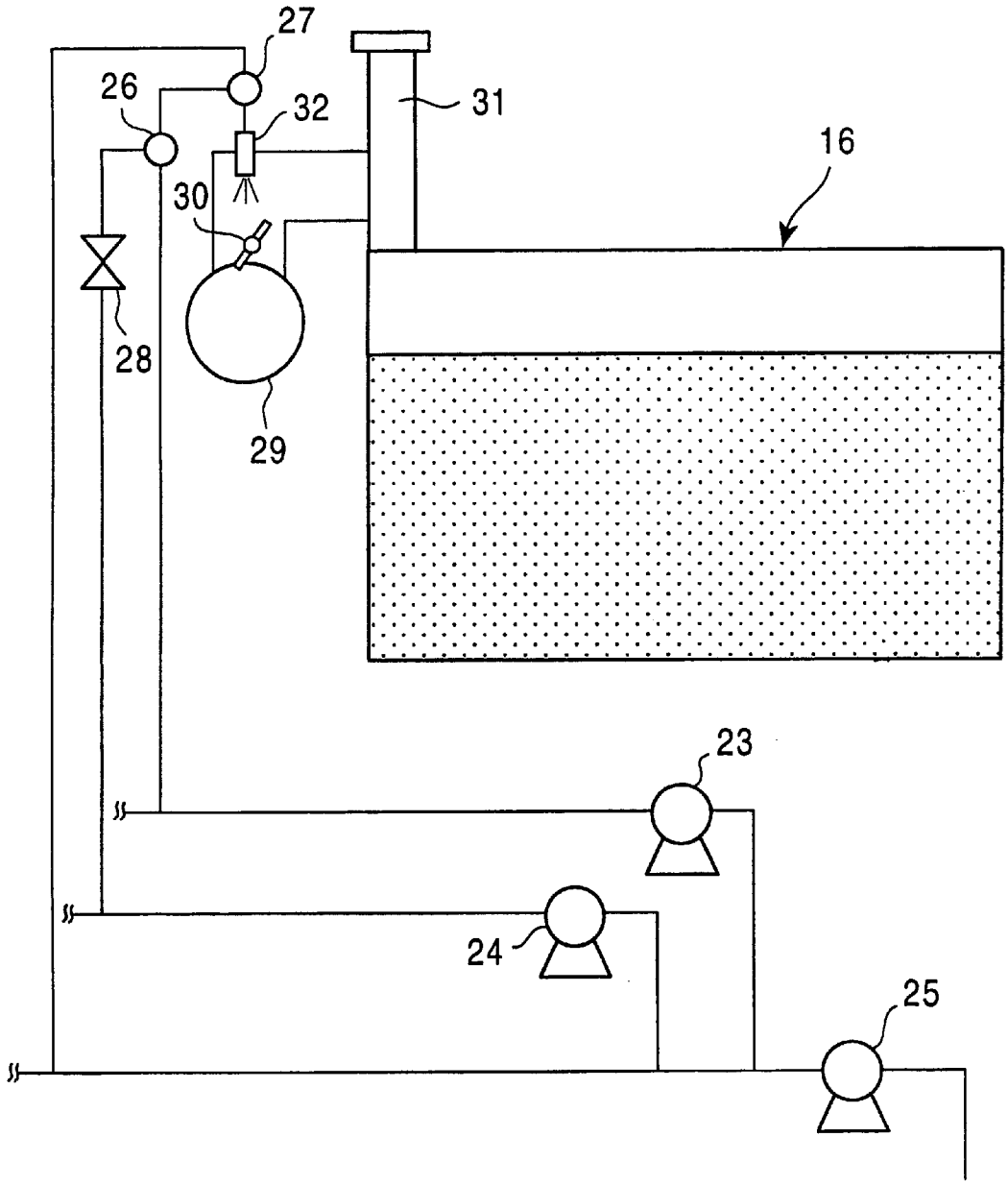
FIG. 6 is an explanatory view showing an outline of the present invention when applied to a chamber type coke oven.

FIG. 6 shows one example of a construction of a pressure adjusting apparatus of the present invention when applied to a chamber type coke oven. The chamber type coke oven comprises a plurality of coking chambers 16 and a plurality of combustion chambers (not shown) disposed between two of the coking chambers in sandwiched relation. A rising pipe 31 provided with a nozzle 32 for ejecting a pressure fluid to suck coking gas generated in the oven is disposed for each of the coking chambers and is connected to a dry main 29 serving as a gas recovery main pipe.

For each of the coking chambers, there is provided a system connecting to a high-pressure pump 23 capable of supplying a pressure fluid at a fluid pressure of at least about 30 kg/cm$^2$, one or more systems (only one of which is shown in FIG. 6) connecting to a medium-pressure pump 24 capable of supplying a pressure fluid at a fluid pressure in the range of 5–20 kg/cm$^2$, and a system connecting to a low-pressure pump 25 capable of supplying a pressure fluid at a fluid pressure of not higher than about 5 kg/cm$^2$. In addition, the pressure adjusting apparatus includes a switching A valve 26 between the system under the fluid pressure of at least about 30 kg/cm$^2$ and the system under the fluid pressure in the range of 5–20 kg/cm$^2$, a switching B valve 27 between the system selected by the switching A valve 26 and the system under the fluid pressure of not higher than 5 kg/cm$^2$, a valve 28 capable of adjusting the pressure in the system under the fluid pressure in the range of 5–20 kg/cm$^2$, and a gas recovery valve 30.

A process of adjusting the pressure in the coking chamber of the coke oven by using the pressure adjusting apparatus will now be described.

Figure 4:
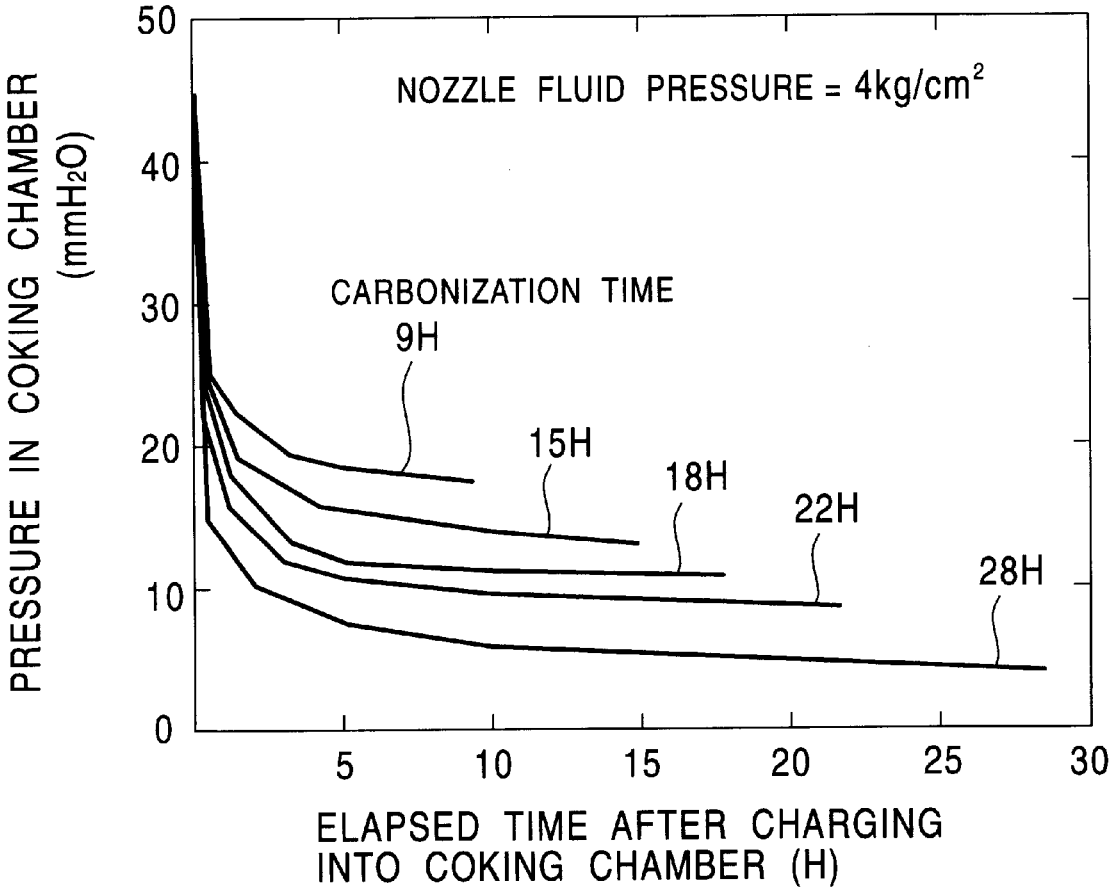
FIG. 4 is a characteristic graph showing time-lapse changes in the pressure in the coking chamber for different durations of carbonization.

FIG. 4 shows one example of time-lapse changes in the pressure in the coking chamber resulting when the carbonization time is varied from 9 hours to 24 hours and the fluid pressure applied to the nozzle in the rising pipe is set to 4 kg/cm$^2$. In any case, the pressure in the coking chamber is high immediately after charging the coal and then decreases quickly thereafter. However, as the carbonization time becomes shorter, the pressure in the coking chamber shifts such that it stays higher until reaching the end of carbonization. The reason why the pressure in the coking chamber is high immediately after charging the coal is that the coal held at the normal temperature immediately after the charging is quickly heated with an atmosphere in the coking chamber kept at a temperature as high as nearly 1000° C., and therefore vaporization of moisture and partial decomposition of volatile components of coal proceeds quickly. The high pressure immediately after charging does not cause undesirable gas leakage from the chamber, since the gas at that time is mainly composed of steam. Also, the fact that as the carbonization time becomes shorter, the pressure in the coking chamber shifts while keeping a higher level, is attributable to the temperature in the coking chamber being maintained relatively high because the amount of heat required for coking the coal must be supplied for shorter durations of carbonization.

Figure 5:
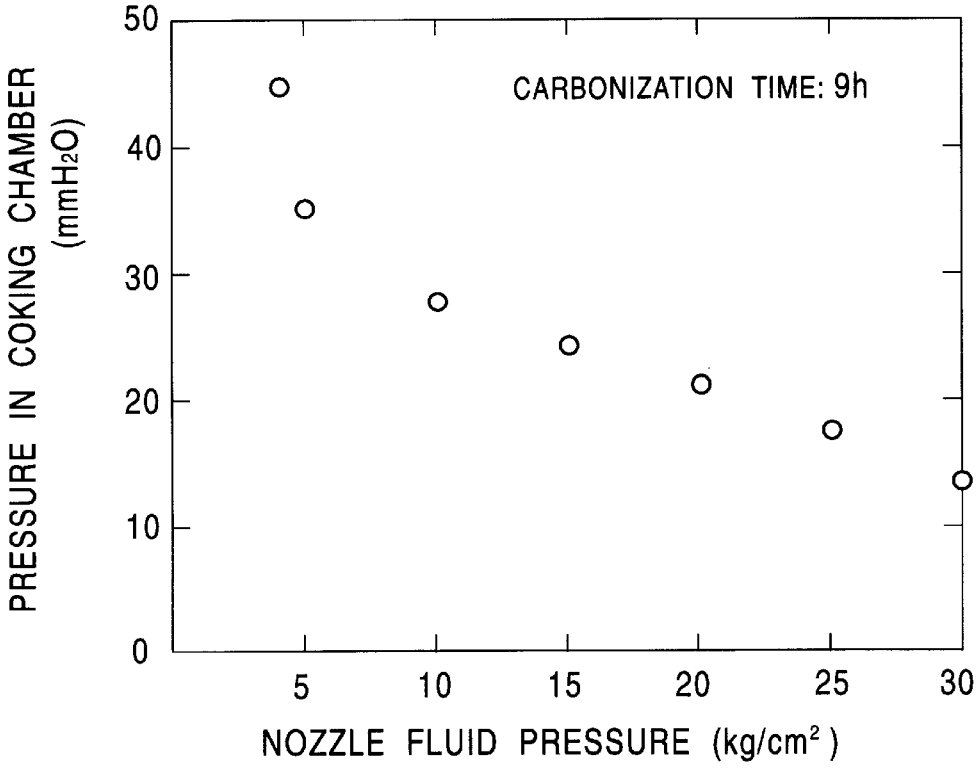
FIG. 5 is a characteristic graph showing the relationship between the fluid pressure in a nozzle and the pressure in the coking chamber.

FIG. 5 shows one example of changes in the pressure in the coking chamber resulting when the fluid pressure applied to the nozzle in the rising pipe is raised to 4 kg/cm$^2$ or above and the carbonization time is set to 9 hours, taking as a basis for comparison the case where the fluid pressure applied to the nozzle is 4 kg/cm$^2$ and the pressure in the coking chamber is 45 mm$H_2O$. Raising the fluid pressure applied to the nozzle makes it possible to enhance the ejector effect and lower the pressure in the coking chamber. More specifically, in comparison with 45 mm$H_2O$ associated with the fluid pressure of 4 kg/cm$^2$, the pressure in the coking chamber can be lowered to about 30 mm$H_2O$ at a fluid pressure of 30 kg/cm$^2$ and to about 10 mm$H_2O$ at a fluid pressure of 5 kg/cm$^2$.

According to visual observation, gas leakage through the door of the coking chamber does not occur until the pressure in the coking chamber rises to 20 mm$H_2O$ above atmospheric, and mixing of black smoke into the exhaust gas due to leakage of coal dust into the combustion chamber does not occur provided the pressure in the coking chamber is not more than about 10 mm$H_2O$ above atmospheric. Therefore, the fluid pressure applied to the nozzle in the rising pipe should be adjusted to hold the pressure in the coking chamber to a value not higher than about 10 mm$H_2O$ above atmospheric.

The coke oven can be operated as follows based on the time-lapse changes in the pressure in the coking chamber resulting from the carbonization time being varied, and the changes in the pressure in the coking chamber resulting from the fluid pressure applied to the nozzle in the rising pipe being varied, those changes being checked and determined beforehand as explained above.

Duration of Carbonization is 9 Hours: (see FIGS. 4 and 5)

The pressure in the coking chamber is controlled by using the high-pressure pump of 30 kg/cm$^2$ at the time of charging the coal, setting the medium-pressure pump to a medium pressure of about 20 kg/cm$^2$ and switching over to it after charging the coal, and then switching over to the low-pressure pump of 5 kg/cm$^2$ after about 5 hours has elapsed. With such a control process, the coke oven can be operated without gas leakage through the door and without black smoke exhaust through the chimney.

More specifically, by setting the fluid pressure applied to the nozzle in the rising pipe to 30 kg/cm$^2$ at the time of charging the coal, the pressure in the coking chamber is reduced by about 30 mm$H_2O$ in comparison with that generated at 4 kg/cm$^2$ (see FIG. 5), as explained above. As is apparent from referring to the characteristic curve in FIG. 4 which represents the case of the carbonization time being 9 hours, therefore, the pressure in the coking chamber can be held to a value of not more than about 10 mm$H_2O$ above the atmospheric pressure at the time of charging the coal. With the passage of time, the pressure in the coking chamber decreases. Before the pressure in the coking chamber decreases to 5 mm$H_2O$ below the atmospheric pressure, the fluid pressure applied to the nozzle in the rising pipe is reduced to 20 kg/cm$^2$. By so reducing the fluid pressure, the pressure in the coking chamber is reduced about 23 mm$H_2O$ in comparison with that generated at 4 kg/cm$^2$, as is apparent from FIG. 5. The pressure in the coking chamber can be therefore held not lower than about 5 mm$H_2O$ below the atmospheric pressure. With the further passage of time, the pressure decrease in the coking chamber moderates. After 5 hours from the charging of the coal, the fluid pressure applied to the nozzle in the rising pipe is reduced to 5 kg/cm$^2$. By so reducing the fluid pressure, the pressure in the coking chamber is reduced about 10 mm$H_2O$ in comparison with that generated at 4 kg/cm$^2$, as explained above. As is apparent from referring to FIG. 4, therefore, the pressure in the coking chamber can be kept at 7–9 mm$H_2O$ above the atmospheric pressure.

Thus, by previously determining;

A) the relationship between the time elapsed after charging the coal in the coking chamber and the pressure in the coking chamber (e.g., FIG. 4), and B) the relationship between the fluid pressure applied to the nozzle and the pressure in the coking chamber (e.g., FIG. 5), the pressure in the coking chamber can be controlled through the steps of:

1) determining, from the relationship A, a value of the pressure in the coking chamber for the reference case (4 kg/cm$^2$ in FIG. 4) depending on the elapsed time after charging the coal, 2) determining a difference between the value determined from the relationship A and a target value of the pressure in the coking chamber, 3) determining, from the relationship B, a value of the fluid pressure applied to the nozzle which gives a pressure value corresponding to the determined difference, 4) setting the fluid pressure applied to the nozzle to the fluid pressure value determined from the relationship B, and 5) adjusting the fluid pressure applied to the nozzle to be coincident with the set value.

Further, in the cases of the carbonization time being 15 hours and 22 hours, the pressure in the coking chamber is controlled as follows through similar steps to those in the above case of 9 hours by determining the relationship between the fluid pressure applied to the nozzle and the pressure in the coking chamber.

Duration of Carbonization is 15 Hours:

The pressure in the coking chamber is controlled by using the high-pressure pump of 30 kg/cm$^2$ at the time of charging the coal, setting the medium-pressure pump to a medium pressure of about 15 kg/cm$^2$ and operating it instead after charging the coal, and then operating the low-pressure pump instead after the passage of about 3 hours. With such a control process, the coke oven can be operated without gas leakage through the door and without black smoke exhaust through the chimney.

Duration of Carbonization is 22 Hours:

The pressure in the coking chamber is controlled by using the high-pressure pump of 30 kg/cm$^2$ at the time of charging the coal, setting the medium-pressure pump to a medium pressure in the range of about 10–15 kg/cm$^2$ and operating it instead after charging the coal, and then operating the low-pressure pump instead after about 3 hours have passed. With such a control process, the coke oven can be operated without gas leakage through the door and without black smoke exhaust through the chimney.

Since the tightness of the door mounting to the oven and looseness of joints between bricks of the coking chamber are not uniform for all the coking chambers, the valve 28 provided in the pressure fluid supply system for each coking chamber and the gas recovery valve 30 provided at a port of each rising pipe communicating with the dry main are regulated in accordance with the results of visual observation before starting to operate the coke oven. Valve 28 is preferably used for fine control of pressure in a coking chamber. As a result, satisfactory operation can be simply and effectively achieved without complicated or maintenance-intensive control for each of the coking chambers.

EXAMPLE 2

Using a chamber type coke oven having an average chamber width of 450 mm, a chamber length of 15 m and a coal charging capacity of 35 tons, coal that was previously adjusted to have a moisture content of 5.5% was carbonized at a combustion chamber of temperature of 1100° C. for a total coking time of 15 hours.

The operation of the coke oven was continued for 10 days by repeating a process of using the high-pressure pump for 30 kg/cm$^2$ at the time of charging the coal, setting the medium-pressure pump to a medium pressure of about 15 kg/cm$^2$ and operating it instead after charging the coal, and then operating the low-pressure pump for 5 kg/cm$^2$ about 3 hours had passed. The pressure in the coking chamber was held within the range from about 10 mm$H_2O$ above atmospheric to about 5 mm$H_2O$ below atmospheric, except for ten minutes at the beginning of charging coal.

Comparative Example 2-1

Coal adjusted to have the same characteristics as in Example 2 was carbonized using the same equipment and process conditions as in Example 2, except as follows:

The system disclosed in Japanese Unexamined Patent Publication No. 6-41537 was installed in each of five coking chambers. After setting a control pressure in the coke oven to fall in the range of atmospheric to 10 mm$H_2O$ below atmospheric, the pressure in the coking chamber was adjusted through damper opening control in accordance with a positive pressure signal of 60 mm$H_2O$ and blowing of the pressure fluid at 7 kg/cm$^2$ through a nozzle provided in the rising pipe. In the end stage of carbonization, the control pressure in the coke oven was set to atmospheric. By repeating such a pressure adjusting process, the operation of the coke oven was continued for 10 days.

Comparative Example 2—2

Coal adjusted to have the same characteristics as in Example 2 was carbonized using the same equipment and process conditions as in Example 2, except as follows: The operation of the coke oven was continued for 10 days by repeating a process of using the high-pressure pump of 30 kg/cm$^2$ at the time of charging the coal, and setting the low-pressure pump to a pressure of 4 kg/cm$^2$ and operating it instead after charging the coal.

Gas leakage through the door and exhaust of black smoke were checked for the 10 days. The results are shown in Table 2.

The occurrence of gas leakage and black smoke was evaluated by determining a proportion of the number of doors, through which gas leaked during the operation time of 8:00–17:00, with respect to the total door number, and a proportion of time, during which black smoke was exhausted, with respect to the operation time of 8:00–17:00.

TABLE 2

| | Ex. 2 | Comp. Ex. 2-1 | Comp. Ex. 2-2 |
|---|---|---|---|
| Gas leakage through door (%) | 0 | 25 | 38 |
| Black smoke (%) | 0 | 15 | 45 |
| Number of maintenance operations | none | 7 | none |
| Number of chambers used | 102 | 5 | 102 |

In Example 2 according to the present invention, neither gas leakage nor black smoke were observed and maintenance work was not needed for the 10 days.

Comparative Example 2-1 showed relatively good results, but maintenance work such as cleaning of the pressure outlet of each of the five coking chambers was needed. At the time of carrying out the maintenance work, there occurred gas leakage through the door and exhaust of black smoke through the chimney.

In Comparative Example 2—2, since the pressure fluid was blown through the nozzle by the low-pressure pump after charging the coal, the pressure in the coking chamber was not sufficiently controlled and there occurred gas leakage through the door and exhaust of black smoke through the chimney more frequently than in Comparative Example 2-1. The situation required in fact maintenance work such as cleaning of the door, but the maintenance work was not carried out for the purpose of continuing the experiment.

As explained above, the present invention provides advantages in that, by operating a coke oven according to the present invention, the amount of coal accumulated and solidified in gas passageways is greatly reduced and the occurrence of gas leakage is correspondingly suppressed. Suppression of gas leakage in turn increases the coking gas recovery. The duration of effective operation temperature for both longitudinal ends of a combustion chamber is prolonged and the yield of coke blocks is improved. By using the pressure adjusting apparatus according to the present invention, the pressure in the oven (the pressure in the coking chamber) can be adjusted to and held at an appropriate value. The amount of tar attaching to the door is reduced and the number of maintenance operations such as cleaning of the door is also greatly reduced. Furthermore, joints between bricks of the coking chamber can be held in a satisfactory condition and maintenance work such as tightly filling the joints is eliminated.

It is to be noted that while the present invention has been described by taking a chamber type coke oven as an example, the invention is applicable to any process of carbonization so long as the coke oven is of the type having a rising pipe for each coking chamber.

What is claimed is:

1. A method of operating a chamber coke oven having coking chambers and combustion chambers and vertically extending gas passageways at opposite longitudinal ends of each of the coking chambers between oven bricks and an inner surface of a door, the method comprising the steps of:

charging coal which is adjusted to have a moisture content of not higher than about 6% into the coking chambers;

holding the pressure in each of said coking chambers at a value at or about atmospheric pressure during an initial stage of coking;

independently controlling the temperature at opposite longitudinal ends of each of said combustion chambers to within a predetermined range by supplying fuel gas and combustion gas to both longitudinal ends of each of the combustion chambers separately from a main burner for the respective combustion chamber to raise the temperature at both longitudinal ends of each of the coking chambers to accelerate carbonization of coke at both longitudinal ends of the oven; and sucking coking gas via said gas passageways.

2. The method according to claim 1, wherein the temperature at the opposite longitudinal ends of each of the combustion chambers is set to be at least about 1000° C., and the pressure in the coking chambers during the first 20% of total coking time is kept in a range from about 5 $mmH_2O$ below atmospheric pressure to about 10 $mmH_2O$ above atmospheric pressure.

3. The method according to claim 1, further comprising a preliminary step of determining a relationship between carbonization time and pressure in each of the coking chambers and a relationship between fluid pressure applied to a nozzle in a rising pipe and pressure in each of the coking chambers for each of the coking chambers, and varying a fluid pressure applied to said nozzle and a pressure in each of the coking chambers over time based on said relationships.

4. The method according to claim 3, wherein the pressure in each of the coking chambers within a period from an initial stage of coking to the end of coking is held at a value at or about atmospheric pressure.

5. A method of operating a chamber coke oven that has coking chambers, combustion chambers, and vertically extending gas passageways at opposite longitudinal ends of each of the coking chambers that are between oven bricks and an inner surface of a door of the respective coking chamber, the method comprising the steps of:

charging coal which has a moisture content not higher than about 6% into the coking chambers;

holding a pressure in each of the coking chambers at or about atmospheric pressure during an initial stage of coking;

accelerating carbonization of coke at both the longitudinal ends of each of the coking chambers by raising the temperature at both longitudinal ends of each of the combustion chambers during the initial stage of coking to within a first temperature range by supplying fuel gas and combustion gas to end flue burners at both the longitudinal ends of each of the combustion chambers separately from a main burner for the respective combustion chamber; and drawing coking gas through the gas passageways.

6. The method of claim 5, wherein the initial stage of coking is about 20% of total coking time, wherein the pressure in each of the coking chambers during the initial stage of coking is from about 5 $mmH_2O$ below atmospheric pressure to about 10 $mmH_2O$ above atmospheric pressure, and wherein a lower end of the first temperature range is about 1000° C.

7. The method of claim 6, wherein the first temperature range is 1000° C. to 1020° C. and the pressure in each of the coking chambers during the initial stage of coking is from about 5 $mmH_2O$ above atmospheric pressure to about 10 $mmH_2O$ above atmospheric pressure.

8. The method of claim 5, wherein the initial stage of coking is about 20% of total coking time and a lower end of the first temperature range is about 1000° C.

9. The method of claim 8, wherein the first temperature range is 1000° C. to 1020° C.

10. The method of claim 5, wherein the initial stage of coking is about 20% of total coking time and the pressure in each of the coking chambers during the initial stage of coking is from about 5 $mmH_2O$ below atmospheric pressure to about 10 $mmH_2O$ above atmospheric pressure.

11. The method of claim 10, wherein the pressure in each of the coking chambers during the initial stage of coking is from about 5 $mmH_2O$ above atmospheric pressure to about 10 $mmH_2O$ above atmospheric pressure.

* * * * *